US006079051A

United States Patent [19]

Whinston et al.

[11] Patent Number: 6,079,051

[45] Date of Patent: Jun. 27, 2000

[54] WAIST CLOSURE SYSTEM FOR WATERPROOF PULL-OVER JACKET

[75] Inventors: Ann K. Whinston, Portland, Oreg.; Bert Edward Roper, Jr., McCall, Id.; Paul H. Gunderson, Portland; Alice M. Summers, Scappoose, both of Oreg.

[73] Assignee: O. S. Systems, Incorporated, Scappoose, Oreg.

[21] Appl. No.: 09/170,949

[22] Filed: Oct. 13, 1998

[51] Int. Cl.[7] ..... A41B 1/12; A41D 3/02; A41D 1/00; A41D 1/02

[52] U.S. Cl. ..... 2/108; 2/85; 2/93; 2/69

[58] Field of Search ..... 2/108, 87, 121, 2/128, 219, 159, 76, 84, 85, 69, 69.5, 91, 93, 94, 96, 99, 100, 220, 221, 235, 236, 237, 309, 311, 312, 322, 336, 338, 269, 270

[56] References Cited

U.S. PATENT DOCUMENTS

| | | | |
|---|---|---|---|
| 3,793,645 | 2/1974 | Kadison | 2/221 |
| 3,835,473 | 9/1974 | Toyoda | 2/237 |
| 4,843,647 | 7/1989 | Phillips, Sr. et al. | 2/69 |
| 5,331,915 | 7/1994 | Snyder | 114/347 |
| 5,489,260 | 2/1996 | Striano | 602/19 |
| 5,511,507 | 4/1996 | Allen | 114/347 |

OTHER PUBLICATIONS

Navarro Weather Gear Spring–Summer 1999 product catalog (19 pages).

1999 Lotus Designs Dealer Workbook (photocopy)(6 pages).

*Primary Examiner*—Michael A. Neas

*Assistant Examiner*—Robert H Muromotodr

*Attorney, Agent, or Firm*—Klarquist Sparkman Campbell Leigh & Whinston LLP

[57] ABSTRACT

A waterproof pull-over jacket for water sports is provided with a waterproof waist closure system having a stretchable longitudinal fabric member attached to the lower edge of the jacket and folded up longitudinally to form a casing at the front and at the back. The fabric member comprises a layer of textured neoprene with a skin of nylon fabric laminated thereto. Nylon web members are received in the casing at the front and back of the jacket, exiting the casing at the sides. A buckle is attached to the ends of the back web member such that when the ends of the front web member are engaged with the buckles, the web members from a continuous strap around the waist. The two web members are each securely attached to the casing at the center of the jacket at the front and at the back to divide the strap into four quadrants. Pulling on the ends of the front web member applies tension substantially equally to each of the four quadrants while cinching the strap about the wearer's waist. The fabric member of the casing provides a continuous circumferential waterproof compression seal along each of the four quadrants. Attaching the web members to the casing maintains them securely within the casing and circumferentially in position about the wearer's waist.

10 Claims, 3 Drawing Sheets

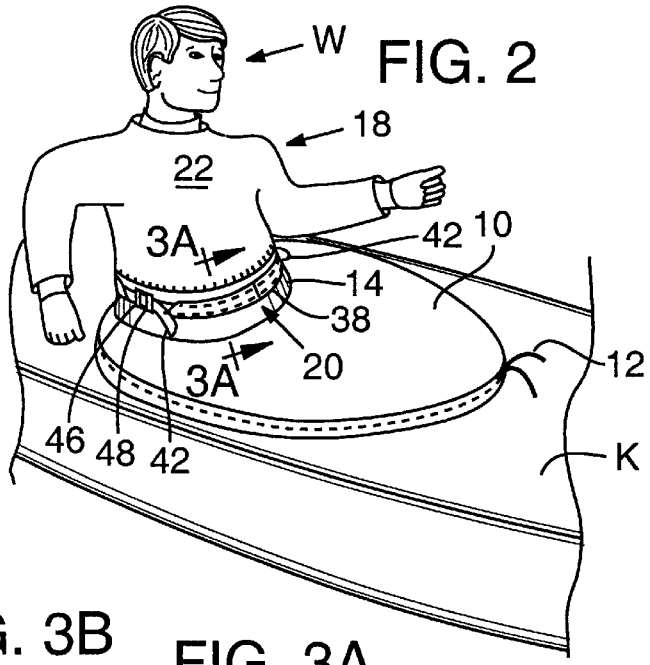
FIG. 2
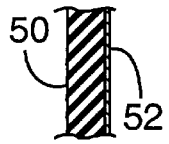
FIG. 3C
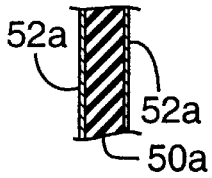
FIG. 3D
FIG. 3B
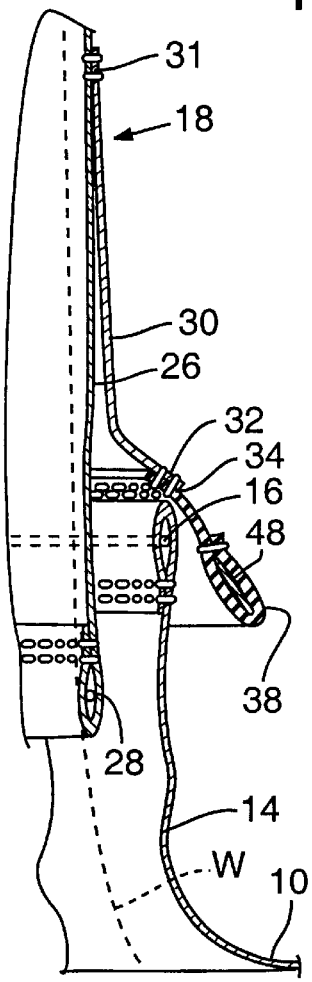
FIG. 3A
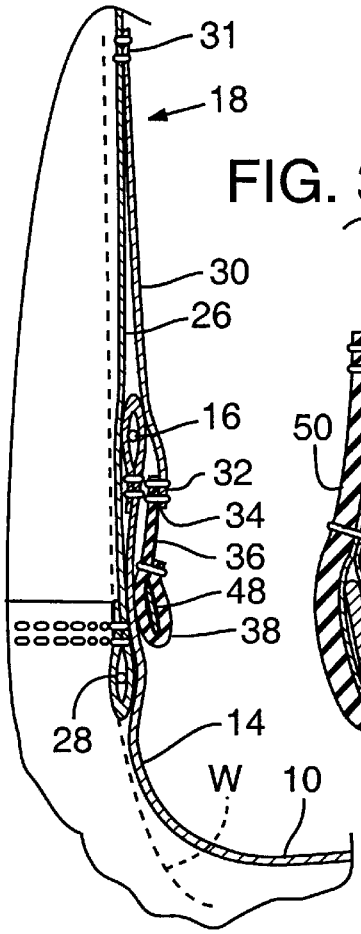
FIG. 3E
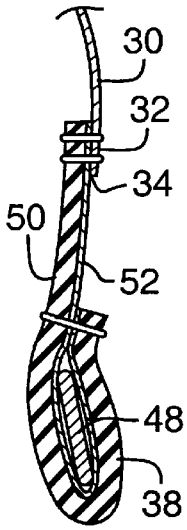
FIG. 3F
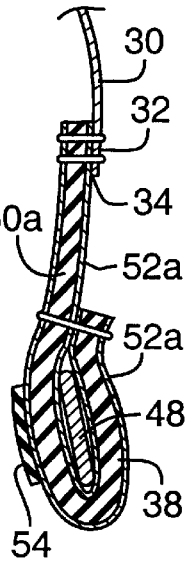

WAIST CLOSURE SYSTEM FOR WATERPROOF PULL-OVER JACKET

FIELD OF THE INVENTION

This invention relates to waterproof pull-over jackets for water sports and, more particularly, to such jackets known as "dry tops" used by white water rafters, kayakers, and other water sport participants.

BACKGROUND OF THE INVENTION

Dry tops used in white water rafting, kayaking and similar water sports are typically made with either single or double waist systems. When fabricated for use in a kayak that itself is provided with a spray skirt for sealing the cockpit, the dry top is typically provided with an inner waist or tunnel portion over which the kayak spray skirt is positioned and, additionally, a spray skirt cover whose function is to keep the wearer dry. Such a dry top is known as having a double waist system.

In other cases and for other uses the dry top may eliminate the inner waist portion such that it is in essence a single jacket. Such a dry top is known as having a single waist system.

In both single and double waist systems the spray skirt cover or the jacket itself is provided with a waist closure system whose primary purpose is to keep the water out. Such a waist closure system must enable the spray skirt cover or the jacket itself to fit the wearer snugly; to grip the wearer securely about the waist, thereby to stay in place; to be relatively easy and economical to fabricate; to be durable; and of course, to keep the water out.

Some prior art closure systems have been fabricated by folding a longitudinally extending fabric member attached to the lower edge of the jacket or spray skirt cover such as to form a circumferentially extending casing which extends around the lower edge of the jacket or spray skirt cover. An elastic bungee cord is passed through the casing, exiting the casing at the front of the garment through a grommet and is provided with a cord closure to enable the cord to be tightened about the user's waist. The cord is, of course, free to move within the casing. Because the closure system is tightened by pulling the bungee cord forwardly at the front of the jacket, it is difficult to obtain sufficient tension to provide a truly efficient waterproof seal especially at the back of the jacket. Additionally, cord closures or locks are not very stable, particularly when wet, and this makes it difficult to maintain whatever seal can be obtained.

The circumferentially extending casings in these closure systems have been made of Lycra® spandex fiber (Lycra® is a registered trademark of DuPont); nylon-1-neoprene (a layer of neoprene having a layer of nylon laminated on one side), the layer of neoprene being disposed adjacent the waist of the wearer); and nylon-2-neoprene (a layer of neoprene having an exterior layer of nylon laminated to both sides), with an additional piece of gripper elastic applied interiorly of the casing to hold the garment in place.

Other prior art closure systems have eschewed casings and bungee cords and instead have utilized a waist band comprising a circumferential strip of nylon-2-neoprene at the lower edge of the garment with a Velcro® hook and loop tab system to cinch the waist band tight. This is a simple system, but not very effective inasmuch as the Velcro® hook and loop closure is not very good at keeping water out. Inasmuch as there is only a single point of closure, the system does not achieve uniform tension circumferentially.

Also, the nylon-2-neoprene tends to stretch over time with use, and the hook and loop closure itself tends to fill up with sand and dirt and frays over time.

Other prior art closure systems have utilized a waist band made of nylon-2-neoprene and have employed straps made of nylon webbing and buckles attached to the waist band at each of the sides of the garment as a means to cinch the waist band about the wearer's waist. The two closures (one at each side of the garment) tend to even the tension out around the waist band and thus represent an improvement over the bungee cord systems and the system utilizing the waist band having a single Velcro® hook and loop tab closure system. However, this system applies the cinching tension directly to the waist band itself. This is disadvantageous inasmuch as nylon-2-neoprene tends to stretch over time with use, thereby requiring more tension on the nylon straps, and this tends to tear the waist band over time.

All the above prior art systems suffer from the disadvantage of having uneven circumferential tension on the waist band. This results in the closure system leaking, particularly at the back of the jacket.

It is thus the principal object of the present invention to provide a waterproof pull-over jacket for use in white water rafting, kayaking and other water sports with a waist closure system that will fit the wearer snugly, stay in place, be easy to manufacture, be durable, and keep the water out.

SUMMARY OF THE INVENTION

Our waist closure system comprises a longitudinal fabric member attached to a lower edge of the jacket which is folded up to form a casing at the front and at the back of the jacket. A first web member is received in the casing at the front of the jacket and exits the casing adjacent each of the sides of the jacket at the front thereof. A second web member is received in the casing at the back of the jacket and exits the casing at each of the sides of the jacket at the rear thereof. A buckle is attached to each of the ends of one of the first and second web members such that the ends of the other of the first and second web members engages the buckles at the ends of the other of the web members to form a continuous strap encircling the waist of the wearer.

Each of the first and second web members is securely attached to the casing substantially centrally of the jacket at the front and the back thereof to divide the strap into four quadrants. Pulling on each of the ends of the other of the first and second web members applies tension to each of the four quadrants of the strap substantially equally while cinching the strap about the waist of the wearer. The strap is maintained securely within the casing and circumferentially in position about the waist of the wearer while the casing provides a continuous circumferential waterproof compression seal along each of the four quadrants.

BRIEF DESCRIPTION OF THE DRAWINGS

FIG. 2 is a perspective view of the kayaker shown in FIG. 1A to a larger scale.

FIG. 3A is a sectional view taken on line 3A—3A of FIG. 2 illustrating the components of the waist closure system in the installed mode, shown to a larger scale.

FIG. 3B is a view of the components shown in FIG. 3A in a loosened installation mode.

FIG. 3C is an enlarged sectional view of a type of fabric suitable for use in the longitudinal fabric member of the invention.

FIG. 3D is an enlarged sectional view of an alternate type of fabric suitable for use in the longitudinal fabric member of the invention.

FIG. 3E is an enlarged sectional view of the longitudinal fabric member shown in FIG. 3C and illustrating a web member received in the casing.

FIG. 3F is an enlarged sectional view similar to FIG. 3E illustrating the alternate type of fabric shown in FIG. 3D.

DESCRIPTION OF THE PREFERRED EMBODIMENT

Figures 1A, 1B:
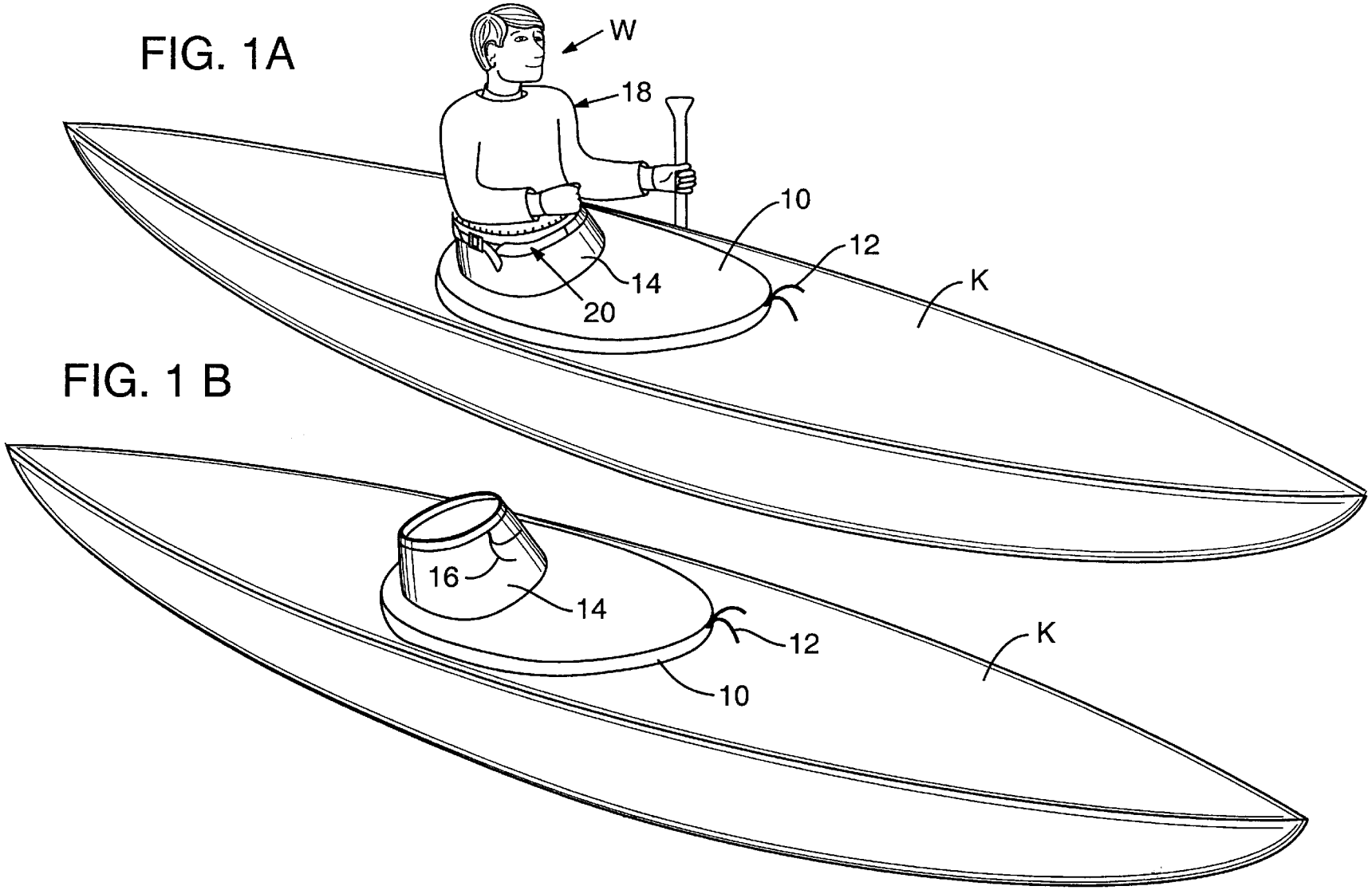
FIG. 1A is a perspective view of a kayaker wearing a waterproof pull-over jacket or dry top provided with a waist closure system according to the invention.
FIG. 1B is a perspective view of the kayak equipped with a spray skirt for sealing the cockpit.

Referring to the drawings, FIGS. 1A and 1B illustrate a kayaker W seated in a kayak K equipped with a standard kayak spray skirt 10 used to keep water out of the cockpit. The spray skirt 10 is attached to the kayak by a bungee cord 12. The spray skirt typically includes a waist encircling portion 14, which is also provided with a bungee cord 16 for snugly affixing the skirt 10 to the waist of the kayaker W.

The kayaker W is illustrated wearing a waterproof pull-over jacket 18 provided with the waist closure system 20 of the invention. The jacket 18, typically made of waterproof coated nylon fabric, has a front 22 and a back 24. As is typical in kayaking jackets, the jacket 18 is provided with an inner waist or tunnel portion 26, which is equipped with a bungee cord 28 for cinching the tunnel portion 26 about the wearer's waist. (The tunnel portion 26 is essentially the lower portion of the jacket 18.)

The jacket 18 is also provided with a spray skirt cover 30 stitched circumferentially along stitch line 31 to the upper portion of the jacket 18 itself. Spray skirt cover 30 is adapted to overlie the kayak spray skirt 10. The function of the waist closure system 20, which is attached as by stitching along stitch line 32 to the lower edge 34 of the spray skirt cover 30, is to seal the spray skirt cover 30 to the waist encircling portion 14 of the kayak spray skirt 10 so as to keep the water out.

The jacket 18 together with its spray skirt cover 30 comprise what is known as a jacket with a double waist system. Dry tops not provided with spray skirt covers are known as single waist system dry tops. In these latter types the waist closure system is attached directly to the lower edge of the jacket itself.

The closure system 20 comprises a longitudinal fabric member 36 which is attached to the lower edge 34 of the spray skirt cover 30. As shown, it is folded up longitudinally to form a casing 38 at the front and at the back of the jacket. The fabric member 36 is cut away along forty-five degree angle lines 40 at the front and at the back of the jacket. See FIGS. 4 and 5.

Figure 4:
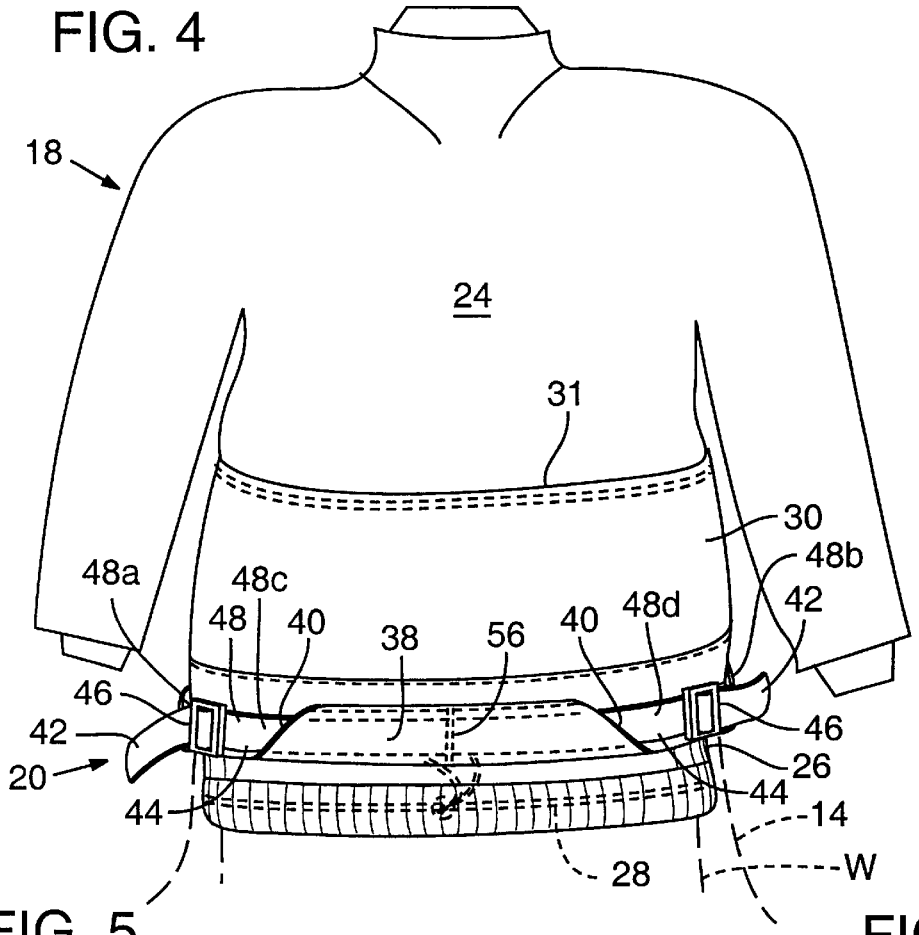
FIG. 4 is a rear view of the jacket with the waist closure system of the invention.
Figure 5:
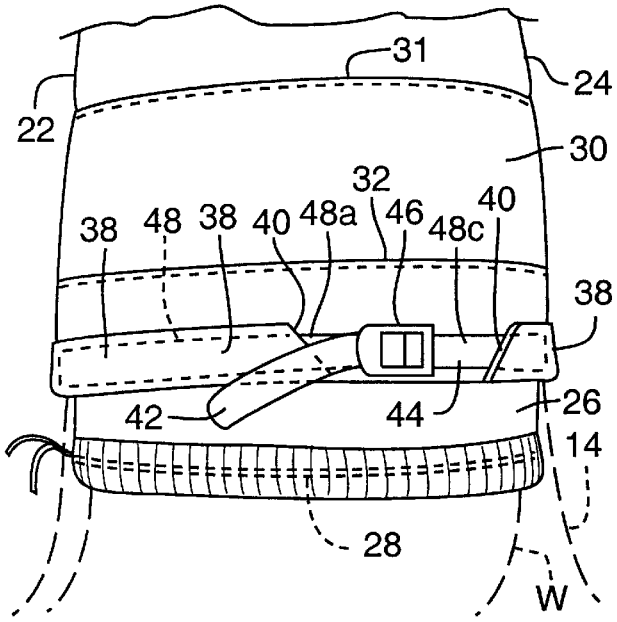
FIG. 5 is a side view of the jacket with the waist closure system of the invention.

A first web member 42 is received in the casing 38 at the front of the jacket and exits the casing 38 as provided for by cutting the fabric member 36 along the lines 40. The first web member 42 thus exits the casing 38 at the front of the jacket 18 as shown in FIG. 5. A second web member 44 is received in the casing 38 at the back of the jacket (see FIGS. 4 and 5), exiting the casing 38 as provided for by cutting the fabric member 36 along the forty-five degree lines 40 at the back of the jacket. The second web member 44 thus exits the casing at the back of the jacket as shown in FIGS. 4 and 5.

A buckle 46 is attached to each of the ends of the second web member 44 such that the ends of the first web member 42 can engage the buckles 46, thereby to form a continuous strap 48 encircling the waist of the kayaker W. See FIGS. 4 and 5. Pulling forwardly on the ends of the first web member 42, when they are engaged with their respective buckles 46, thus applies tension to the strap 48 to cinch the strap tightly about the waist of the wearer.

The fabric member 36 is desirably made of a four inch wide strip of what is known as "nylon-1-neoprene," which is basically a layer of neoprene having a stretchable layer or skin of nylon fabric laminated on one side. The strip is folded or turned up one and one-half inches and stitched to form the casing 38. A desirable product for this purpose is a textured 2.0 mm J-mesh/nylon neoprene, manufactured by JAKO Chemicals Co. Ltd., Korea, and distributed in the United States by Z-Point Inc, d/b/a Instron Co., 14924 South Figueroa Street, Gardena, Calif. 90248, as item code OS 2.0 mesh. The neoprene layer 50 is disposed adjacent the waist of the wearer and the exterior nylon fabric layer 52 is thus exteriorly disposed at the front and the back of the jacket. This product provides sufficient gripping between the layer of neoprene 50 and the waist encircling portion 14 of the kayak spray skirt 10 to avoid movement therebetween. Folding the fabric member 36 up places the neoprene layer 50 exteriorly of the jacket at the lower portion of the longitudinal member 36. See FIG. 3E.

The web members 42 and 44 are desirably made of one inch nylon webbing, provided by PK Supply Corporation, 1075 Industry Drive, Seattle, Wash. 98188, as item No. N1311 1 black. The buckles 46 are desirably one inch Mojave® standard release, curved nylon Tensionlock® buckles, also obtainable from PK Supply Corporation as item No.5393C.

Alternatively, the fabric member 36 may be made of what is known as "nylon-2-neoprene," which is basically a layer of neoprene 50*a* having a layer or skin of stretchable nylon fabric 52*a* laminated on both sides. See FIGS. 3D and 3F. A desirable product for this is also obtainable from Instron Co., Gardenia, Calif. 90248. When nylon-2-neoprene is used for the fabric member 36, a one inch wide strip of gripper elastic material 54 is stitched to the fabric member 36 interiorly of the layer of neoprene 50*a* and adjacent the waist of the wearer to maintain the jacket in position with respect to the wearer's body. See FIG. 3F.

Web members 42 and 44 are each securely stitched to the casing 38 substantially centrally of the casing 38 at the front and the back of the jacket 18 at lines 56 to prevent any movement between the web members and the casing. See FIG. 4 for this stitching at the back of the jacket. The stitching of the web members 42 and 44 to the casing 38 divides the strap 48 into four quadrants 48*a*, 48*b*, 48*c*, 48*d*. Thus, when the wearer pulls the ends of the first web member 42 forwardly, after both of the ends of the web member 42 are engaged with the buckles 46, tension is applied to each of the four quadrants of the strap 48 substantially equally while the strap 48 is cinched tightly about the waist of the wearer. The stitching of the web members 42, 44 to the casing 38 also maintains the web members securely within the casing and circumferentially in position about the wearer's waist.

The pressure thus exerted on the waist encircling portion 14 of the kayak spray skirt 10 by the interior layer of neoprene 50 of the fabric member 36, or by the gripper elastic material 54 when the fabric member 36 is fabricated of nylon-2-neoprene, provides a continuous circumferential waterproof compression seal along each of the four quadrants 48*a*, 48*b*, 48*c*, 48*d*.

Figure 6:
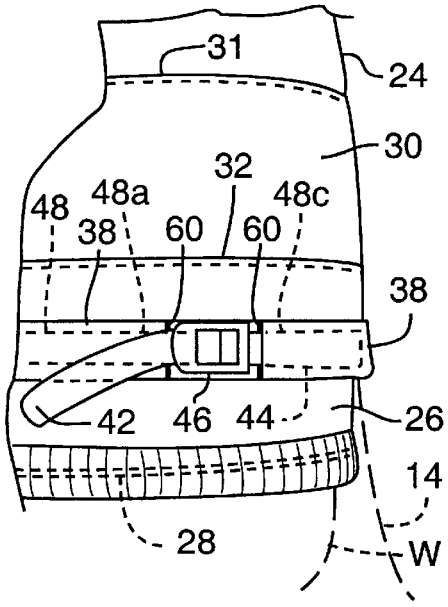
FIG. 6 is a side view illustrating an alternate embodiment.

Alternatively, the casing 38 can be slit as at 60 at each of the sides of the jacket at the front and at the back thereof, such that the web members 42, 44 can exit the casing 38 through the slits 60 before being joined by the buckles 46. See FIG. 6.

Although several preferred embodiments of the invention have been illustrated and described, obviously other embodiments and modifications may be made without departing from the spirit of the invention, and all such embodiments and modifications are intended to be included within the scope of the following claims.

We claim:

1. A closure system for the waist of a waterproof pull-over jacket for water sports, the jacket having a front and a back and a lower edge adapted to encircle the waist of a wearer, the closure system comprising:

a longitudinal fabric member attached to the lower edge of the jacket, the member being folded up longitudinally to form a casing at the front and at the back of the jacket;

a first web member received in the casing at the front of the jacket, the first web member exiting the casing adjacent each of the sides of the jacket at the front thereof;

a second web member received in the casing at the back of the jacket, the second web member exiting the casing adjacent each of the sides of the jacket at the rear thereof; and a buckle attached to each of the ends of one of the first and second web members, the ends of the other of the first and second web members engaging the buckles at the ends of the one web member to form a continuous strap encircling the waist of the wearer, each of the first and second web members being securely attached to the casing substantially centrally of the jacket at the front and the back thereof to divide the strap into four quadrants, whereby pulling on each of the ends of the other of the first and second web members applies tension to each of the four quadrants of the strap substantially equally while cinching the strap about the waist of the wearer, the strap being maintained securely within the casing and circumferentially in position about the waist of the wearer, the casing providing a continuous circumferential waterproof compression seal along each of the four quadrants.

2. A closure system as in claim 1 wherein the longitudinal fabric member comprises a stretchable longitudinal fabric member.

3. A closure system as in claim 2, wherein the longitudinal stretchable fabric member comprises an interior layer of neoprene disposed adjacent the waist of the wearer and an exterior skin of fabric laminated thereto, the longitudinal stretchable fabric member being folded up whereby the layer of neoprene is exteriorly disposed at the front and at the back of the jacket.

4. A closure system as in claim 2, wherein the longitudinal stretchable fabric member comprises an inner layer of neoprene and a skin of fabric laminated on each of the sides thereof, the longitudinal stretchable fabric member further comprising a layer of gripper elastic material attached to the fabric member interiorly of the layer of neoprene and adjacent the waist of the wearer, the layer of gripper elastic material maintaining the jacket in position with respect to the body of the wearer.

5. A closure system as in claim 1, wherein the exterior portion of the casing is cut away at each of the sides of the jacket at the front and at the back thereof, whereby the first and second web members are disposed exteriorly of the jacket at each of the sides thereof.

6. A closure system as in claim 5, wherein the exterior portion of the casing is cut away at forty-five degree angles at each of the sides of the jacket at the front and at the back thereof.

7. A closure system as in claim 1, wherein the casing is slit at each of the sides of the jacket at the front and at the back thereof, the first and second web members exiting the casing through the slits therein.

8. A closure system as in claim 1, wherein the first and second web members comprise nylon web members.

9. A closure system as in claim 1, wherein the buckle is attached to each of the ends of the second web member, the ends of the first web member engaging the buckles at the ends of the second web member to form the continuous strap encircling the waist of the wearer.

10. A closure system for the waist of a waterproof pull-over jacket for water sports, the jacket having a front and a back and a lower edge adapted to encircle the waist of a wearer, the closure system comprising:

a longitudinal stretchable fabric member attached to the lower edge of the jacket, the member being folded up longitudinally to form a casing at the front and at the back of the jacket, the longitudinal stretchable fabric member comprising an interior layer of textured neoprene disposed adjacent the waist of the wearer and an exterior skin of nylon fabric laminated thereto, the longitudinal stretchable fabric member being folded up whereby the layer of neoprene is exteriorly disposed at the front and at the back of the jacket;

a first nylon web member received in the casing at the front of the jacket, the first nylon web member exiting the casing adjacent each of the sides of the jacket at the front thereof;

a second nylon web member received in the casing at the back of the jacket, the second nylon web member exiting the casing adjacent each of the sides of the jacket at the rear thereof;

the casing being cut away at forty-five degree angles at each of the sides of the jacket at the front and at the back thereof, whereby the first and second nylon web members are disposed exteriorly of the jacket at each of the sides thereof;

a buckle attached to each of the ends of the second nylon web member, the ends of the first nylon web member engaging the buckles at the ends of the second nylon web member to form a continuous strap encircling the waist of the wearer, each of the first and second nylon web members being securely attached to the casing substantially centrally of the jacket at the front and at the back thereof to divide the strap into four quadrants, whereby pulling forwardly on each of the ends of the first nylon web member applies tension substantially equally to each of the four quadrants of the strap while cinching the strap about the waist of the wearer, the strap being maintained securely within the casing and circumferentially in position about the waist of the wearer, the interior layer of neoprene of the longitudinal stretchable fabric member providing a continuous circumferential waterproof compression seal with the waist of the wearer along each of the four quadrants.

* * * * *